United States Patent [19]

Porat

[11] Patent Number: 4,653,293

[45] Date of Patent: Mar. 31, 1987

[54] MECHANISM FOR EFFECTING MOVEMENT

[75] Inventor: Itzchak Porat, Leeds, England

[73] Assignee: Guilford Mills Inc., Greensboro, N.C.

[21] Appl. No.: 710,002

[22] Filed: Mar. 11, 1985

[30] Foreign Application Priority Data

Mar. 13, 1984 [GB] United Kingdom ..... 8406466

[51] Int. Cl.[4] ..... D04B 23/04

[52] U.S. Cl. ..... 66/207

[58] Field of Search ..... 66/203, 207, 204

[56] References Cited

U.S. PATENT DOCUMENTS

| | | | |
|---|---|---|---|
| 3,001,388 | 9/1961 | MacCaffray | 112/79.2 |
| 3,006,170 | 10/1961 | Chapius . | |
| 3,089,322 | 5/1963 | Bruce et al. | 66/207 |
| 3,264,947 | 8/1966 | Bidlack . | |
| 3,410,113 | 11/1968 | Bassist . | |
| 3,729,954 | 5/1973 | Ducol . | |
| 3,950,942 | 4/1976 | Namura . | |
| 3,978,690 | 9/1976 | Beling et al. . | |
| 4,173,192 | 11/1979 | Schmidt et al. | 112/79 R |
| 4,483,260 | 11/1984 | Gallant | 112/79 R |

FOREIGN PATENT DOCUMENTS

| | | |
|---|---|---|
| 888701 | 1/1962 | United Kingdom . |
| 888702 | 1/1962 | United Kingdom . |
| 1148789 | 4/1969 | United Kingdom . |
| 1156094 | 6/1969 | United Kingdom . |
| 1196679 | 7/1970 | United Kingdom . |
| 1219790 | 1/1971 | United Kingdom . |
| 1241638 | 8/1971 | United Kingdom . |
| 1247388 | 9/1971 | United Kingdom . |
| 1290281 | 9/1972 | United Kingdom . |
| 1352857 | 5/1974 | United Kingdom . |
| 1445374 | 8/1976 | United Kingdom . |
| 1473344 | 5/1977 | United Kingdom . |
| 1483040 | 8/1977 | United Kingdom . |
| 2049824A | 5/1979 | United Kingdom . |
| 2037822B | 7/1980 | United Kingdom . |
| 2050446B | 2/1983 | United Kingdom . |

OTHER PUBLICATIONS

*Machine Design*, vol. 35, No. 10, Apr. 25, 1983, pp. 158–166 J. Wesley Broome: "Servosystems for Position Control".

*Primary Examiner*—Ronald Feldbaum

*Attorney, Agent, or Firm*—Shefte, Pinckney & Sawyer

[57] ABSTRACT

A mechanism for effecting guide bar lapping movement in warp knitting machines comprises a double-acting piston-in-cylinder servo arrangement connected directly to the guide bar. The piston 13 of the arrangement 11 may be connected by a rigid yoke arrangement 15 to a rod 16 slidable in linear bearings 17 and connected to the guide bar 12.

7 Claims, 5 Drawing Figures

MECHANISM FOR EFFECTING MOVEMENT

BACKGROUND TO THE INVENTION

This invention relates to mechanism for effecting guide bar lapping movement in warp knitting machines.

Hydraulically operated mechanisms have been proposed for effecting the lapping movements of the guide bars of warp knitting machines, of varying degrees of complexity, all claiming to have substantial advantages over the conventional, practical lapping control mechanism, namely the pattern chain, or for simpler patterns, pattern wheel. Nevertheless the pattern wheel or chain is still regarded as the only practical means of patterning warp knitting machines (which, for present purposes, include stitch bonding and other machines that utilize warp-knitting type guide bars). The inference must be that the claimed advantages of hydraulically operated mechanisms, for all their sophistication, are not realised in practice, or at least not fully.

The conventional pattern wheel or chain mechanism still, however, has all the problems and disadvantages that undoubtedly prompted the invention and development of the variously proposed hydraulic (and other) arrangements.

BRIEF DESCRIPTION OF THE INVENTION

The present invention provides a new hydraulic solution to those problems with substantial advantages over prior art proposals inter alia in its relative simplicity and cost effectiveness, its speed and reliability of operation, and the ease and speed with which it can be programmed or re-programmed to knit different patterns of warp knit fabric.

The invention comprises a mechanism for effecting guide bar lapping movement in warp knitting machines comprising a double-acting piston-in-cylinder servo arrangement connected directly to said guide bar.

Said piston-in-cylinder arrangement may comprise a double ended piston.

The piston may be connected by a rigid yoke arrangement to a rod, slidable in linear bearings and connected to said guide bar. Such an arrangement has the merit that loads, and particularly sidewards-acting loads, are taken off the piston-in-cylinder arrangement per se so as to reduce the wear and tear on the piston and its immediate bearings, and further facilitates rapid exchange of a worn or faulty piston-in-cylinder arrangement.

Said piston-in-cylinder arrangement may be connected to said guide bar through a connecting rod that accommodates movements of said guide bar transverse to the axis of the piston-in-cylinder arrangement. Such a rod may be held to the piston at one end and to the guide bar at the other end in spherical bearings, which permit the necessary motion to accommodate the swinging movements of the guide bar as it passes the guiders between the needles, but gives an essentially zero-play connection in the direction of the lapping movement. Such spherical bearing connection gives further protection to the linear bearings of the arrangement against side loads.

A displacement transducer may also be connected to the piston-in-cylinder arrangement. Said displacement transducer may comprise a linear differential voltage transducer—such a transducer is inexpensive but adapted to give a reproducible output—the output is not necessarily as linear as may be required, but the invention further provides that the output of such a transducer can be calibrated for linearity.

The mechanism may further comprise electrically operated valve means for the piston-in-cylinder arrangement. Said valve means may comprise a four port, torque motor valve. An electrical control signal driving the valve open to admit pressure fluid to one side of the piston (and simultaneously open to permit fluid to exhaust from the other side of the piston) may be balanced by an amplified signal from the displacement transducer when the measured displacement corresponds to the desired displacement.

The mechanism may also comprise an hydraulic accumulator connected to supply hydraulic fluid to said piston-in-cylinder requirements during any period when the said supply arrangement might be inadequate, for example when other mechanisms moving other guide bars are also demanding pressure fluid.

A mechanism for driving a plurality of guide bars in a warp knitting machine may comprise a plurality of piston-in-cylinder arrangements each comprising a piston rigidly connected to a rod, substantially aligned with and connected to one of said guide bars and parallel to but laterally displaced from said piston, whereby said piston-in-cylinder arrangements each comprising a piston rigidly connected to a rod, substantially aligned with and connected to one of said guide bars and parallel to but laterally displaced from said piston, whereby said piston-in-cylinder arrangements, though wider than the spacing between said guide bars, can be accommodated.

A piston-in-cylinder arrangement with a maximum stroke of about 0.05 m will be adequate for most warp knitting machines, but some special machines might require maximum strokes of 0.10 m or even longer. It will be appreciated that any single displacement of a piston will usually be over only one or a small number of needle spaces, but during a pattern repeat a piston may need—as in the case of an Atlas construction—to move over longer distances.

Although in general the piston will act intermediate the ends of the cylinder it might nevertheless on occasion come up against one or other end wall and it is preferred to relieve the piston or the cylinder in the case of a side-ported cylinder so as to avoid the possibility of the piston becoming jammed through there being no path for the fluid to pass from the port to the piston face.

Shaft encoder means, which may be magnetic or optical, may respond to the operation of the main shaft of the knitting machine whereby the movements of the guide bars may be synchronised with the movements of other knitting elements.

Dynamic response of the surface is important particularly at high operational speeds which are usually required in warp knitting and means may be provided activating said mechanism in accordance with the said movments of said other elements so as to compensate for changes in the speed of the knitting machine. Thus a delay of 1 ms between valve actuation and piston movement corresponds to guide bar movement lagging 3.6° behind main shaft position at 600 r.p.m. as compared to inching speed and 7.2° at 1200 r.p.m.

It can be arranged that the signals for valve actuation are given correspondingly earlier the higher the main shaft speed.

Automatic means determining the operation of said piston-in-cylinder arrangement may comprise a computer or data processor programmable with the required lapping movment of the guide bar and operable to cause said piston-in-cylinder arrangement to effect such movement of said guide bar.

BRIEF DESCRIPTION OF THE DRAWINGS

A mechanism for effecting guide bar lapping movement in warp knitting machines according to the invention will now be described with reference to the accompanying drawings in which.

DETAILED DESCRIPTION OF THE PREFERRED EMBODIMENTS

Figure 1:
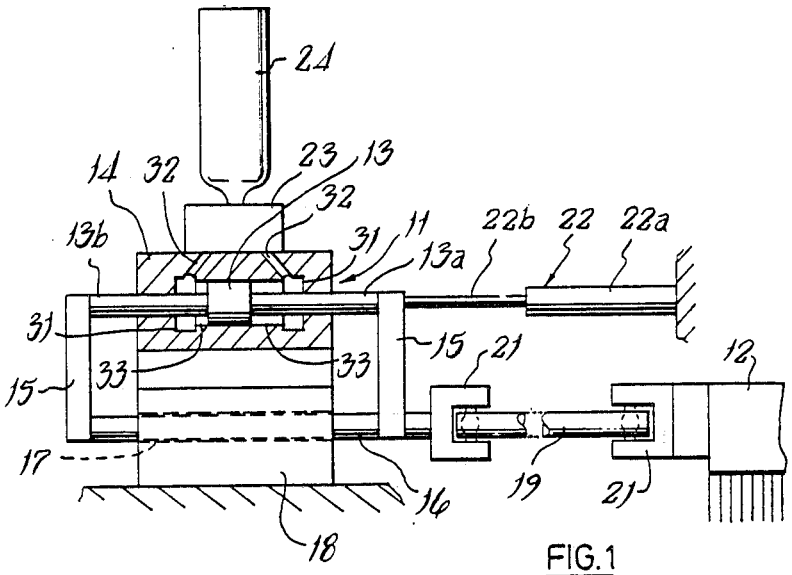
FIG. 1 is a part-sectional side elevation of a mechanism showing its connection to a guide bar.

The mechanism for effecting guide bar lapping movement in warp knitting machines illustrated in FIG. 1 comprises a double-acting piston-in-cylinder servo arrangement 11 connected directly to the guide bar 12.

By "connected directly" is meant that there is a substantially rigid connection between the piston-in-cylinder arrangement 11 and the guide bar 12, and by double-acting in this context is then meant also that the piston-in-cylinder arrangement positively moves the guide bar in both directions.

The piston 13 of the piston-in-cylinder arrangement 11 is double ended having rod parts 13*a*, 13*b* projecting from cylinder 14 of the arrangement 11. The piston 13 is connected by these rod parts 13*a*, 13*b* through a rigid yoke arrangement 15 to a rod 16 slidable in linear bearings 17 in a block 18, and connected to said guide bar 12. The connection to said guide bar 12 is through a connecting rod 19 that accommodates movements of said guide bar 12 transverse to the axis of the piston-in-cylinder arrangement 11. Said connecting rod 19 is joined to the rod 16 at one end and to the guide bar 12 at the other end by spherical bearings 21 that permit the front and back swing movements of the guide bar 12 while holding a rigid, substantially no play, connection so that movements of the piston 13 are reflected precisely in lapping movements of the guide bar 12.

A displacement transducer 22 is arranged with its cylinder 22*a* fixed in the machine and its piston 22*b* fixed to the yoke 15. Such transducers are relatively inexpensive and give highly reproducible output, without necessarily being precisely linear. However, any non-linearity can be calibrated out electronically or by computer programming.

Electrically operated valve means 23, comprising a four port, torque motor valve, are attached to the piston-in-cylinder arrangement 11, two ports being inlet ports to opposite sides of the piston 13, the other two being outlet ports. A hydraulic accumulator 24 is connected to the valve means 23.

Figure 2:
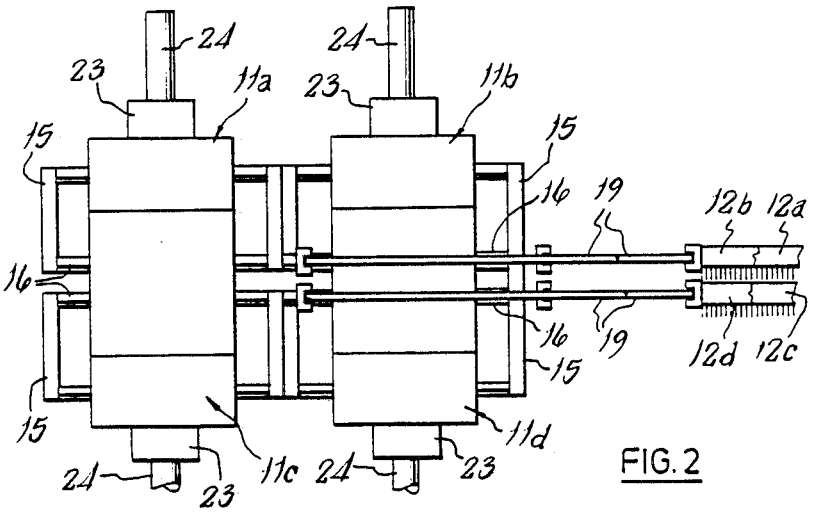
FIG. 2 is a side elevation of a four guide bar arrangement.
Figure 3:
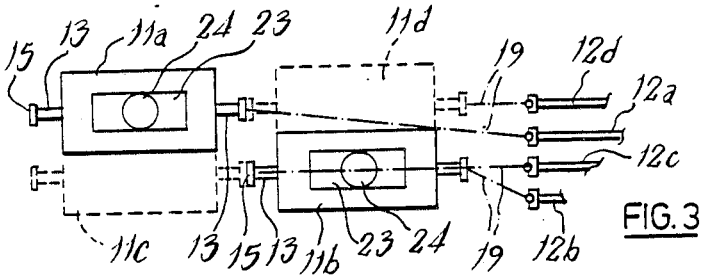
FIG. 3 is a plan view of the arrangement shown in FIG. 2.

FIGS. 2 and 3 show how four piston-in-cylinder arrangements 11*a*, 11*b*, 11*c*, 11*d* as described with reference to FIG. 1 may be mounted at one side of a warp knitting machine to effect the lapping movements of four guide bars 12*a*, 12*b*, 12*c*, 12*d*. The guide bars are necessarily located close together, whereas the piston-in-cylinder arrangements have, by comparison, substantial width. They are accommodated by arranging them in upper and lower pairs, 11*a*, 11*b* and 11*c*, 11*d* respectively, of which pairs one of said arrangements, 11*a*, 11*c* respectively, is arranged axially displaced from the other, 11*b*, 11*d* respectively. The upper and lower arrangements are also inverted with respect to each other so that the attached hydraulic accumulators extend outwardly away from each other. The rods 16 driven through the yokes 15 can thus be all arranged substantially aligned with their respective guide bars.

The arrangement has several advantages over the principal one that the relatively bulky actuators can be accommodated in a relatively small space roughly equivalent to that ordinarily taken up by the conventional pattern wheel or chain equipment (but much less, clearly than is required when long pattern chains are used) and, despite the close spacing of the guide bars, directly drive the same, thereby avoiding the need for complicated linkages that would permit more or less play and hence inaccuracies and irregularites in operation and evential wear and even failure of pivot bearings. By providing the separate linear bearings 17 for the rods 16, side loads on the piston rod and hence on its bearings in the piston-in-cylinder arrangements 11 are avoided, leading to increased life of the arrangements 11. Moreover, in the event that a piston-in-cylinder arrangement goes faulty, it is relatively easily replaced.

The stroke length of the piston is about 0.05 m. In practice, the actual length of any one stroke of the piston 13 for a lapping movement of the guide bar will be very small, usually one or only a few needle spaces, which is to say one or a few millimetres. The arrangement may have to provide however for more substantial displacements as when an Atlas construction is being knitted.

Occasionally, the piston 13 may be driven against one or other end wall 31 of the cylinder 14 and, since the cylinder has side ports 32 the piston 13 might stick against the end wall 31. To avoid this possibility the cylinder 14 and the end bearings are relieved at 33 to permit fluid to flow from the port 32 to act against the piston face.

Figure 4:
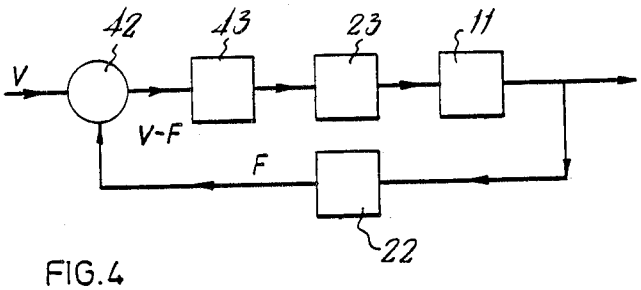
FIG. 4 is a block diagram of the servo arrangement.

FIG. 4 shows a diagram of the servo circuit. A voltage V is input from a control arrangement, to be described further below, to the torque-motor valve 23 through a summing arrangement 42 and an amplifier 43. The valve 23 provides fluid pressure to the piston-in-cylinder arrangement 11 which displaces the guide bar 12 and the piston of the displacement transducer 22. A displacement output voltage F is passed from the displacement transducer to the summing arrangement 42 so that in fact it is a voltage $V-F$ that is fed from there to the amplifier 43. When $V=F$, the valve is shut. It should be understood of course that when the valve admits fluid to one side of the piston 13 the outlet port on the other side of the piston is open.

Figure 5:
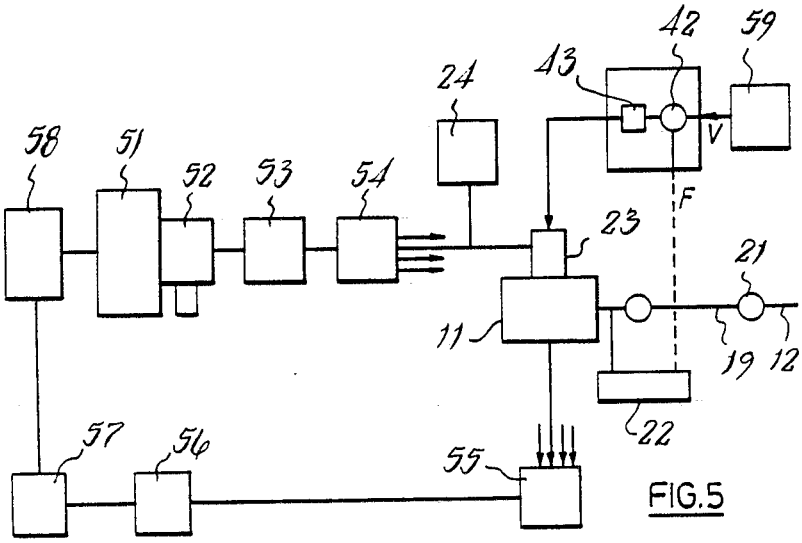
FIG. 5 is a block diagram of the hydraulic arrangement.

FIG. 5 shows a more comprehensive block diagram of the arrangement. Hydraulic fluid from a reservoir 51 is pumped by a pump 52 through a fine filter 53 to a distributor 54 which feeds four similar piston-in-cylinder arrangements, only one, 11, of which is shown. There will in practice of course be as many piston-in-cylinder arrangements as there are guide bars on the machine. The components associated with such arrangement 11 are identified by the reference numerals used previously on FIGS. 1 to 3. Thus the distributor 54 supplies hydraulic fluid to the valve 23 with its connected accumulator 24. The double ended piston 13 drives the guide bar 12 through the connecting rod 19, and also displaces the piston 22b of the displacement transducer 22 which feeds a displacement signal to the summing arrangement 42 which is connected to the torque motor of the valve 23 through the amplifier 43.

Hydraulic fluid exhausted from the arrangement 11 (and from the other similar arrangements) passes to a collector 55 which returns it to the reservoir 51 via a shock absorber 56, a coarse filter 57 and a cooler 58.

Also connected to the summing arrangement 42 is a computer or data processor 59 programmed to give command signals as inputs to the amplifier which in turn actuates the valve 23 to effect movement of the guide bar 12. The processor 59 is connected to an optical or magnetic shaft encoder 61 connected to the main shaft of the knitting machine and which gives to the processor 59 precise information about the instantaneous position and the speed of the main shaft. The processor 59 is programmed to advance or retard the timing of its signals to the valve 23 in accordance with shaft speed to compensate for the dynamic response of the system.

The computer or processor 59 can also monitor other variables such for example as hydraulic pressure and fluid temperature, and of course can be programmed to execute different guide bar movements for different fabric constructions, as well as being operable to control specific movements for example for maintenance and setting up purposes.

Although guide bar movements will ordinarily be over distances corresponding to integral numbers of needle spaces, fractional movements may be required for initial setting up purposes and also to take account of needle bending under thread tensions especially when forming long underlaps. Because of the precision with which the guide bars can be controlled through a computer or other processor, knitting can be carried out at high speeds with less downtime for fault correction than at present. And, of course, the setting up operation for a change of pattern is simplified as compared to the conventional pattern wheel or chain arrangements.

Moreover, because the number of moving and wearing parts is considerably reduced, maintenance requirements are reduced.

What I claim is:

1. A mechanism for effecting guide bar lapping movement in warp knitting, said mechanism comprising:

(a) a fluid drive servo motor means including a cylinder element and a double-acting, piston element arranged therein, one of said cylinder element or said piston elements being movable by fluid introduced into said cylinder, and control means for introducing fluid into said cylinder for causing selective movement of said movable element;

(b) rod means rigidly associated with said movable element for linear movement therewith; and (c) connecting means for connecting said rod means to transmit directly said linear movement of said rod means to said guide bar, said connecting means including spherical bearing means interconnecting said rod means and said guide bar to permit said guide bar to make front and back swing movements with respect to said guide bar without affecting said direct transmission of said linear movement of said rod means to said guide bar.

2. A mechanism as defined in claim 1 and further characterized in that displacement transducer means is associated with said rod means for generating an electrical signal which is a function of said movement of said rod means, and in that said drive motor control means includes an electrically operated valve means for receiving said electrical signal and for selectively controlling said fluid flow to said cylinder in response to said electrical signal.

3. A mechanism as defined in claim 2 and further characterized in that said displacement transducer means generates said electrical signal as a function of the linear movement of said rod means.

4. A mechanism as defined in claim 1 and further characterized in that said fluid drive motor is arranged in a block housing, in that said rod means includes a piston rod connected directly to said piston for linear movement therewith, a yoke rigidly connected to said piston rod and extending in perpendicular relation thereto, and a slide rod rigidly connected to said yoke, said slide rod being arranged for slidable movement in a linear bearing contained in said block housing and extending in spaced parallel relation to the direction of said movement of said piston, and in that said connecting means includes a connecting rod having spherical bearing means at each end thereof for connecting with said slide rod and said guide bar, respectively.

5. A mechanism for effecting the lapping movement of a plurality of guide bars in a warp knitting machine said mechanism comprising:

(a) a plurality of fluid drive motor including a cylinder, a double-acting piston arranged for movement within said cylinder, and a control means for introducing fluid into said cylinder for selectively moving said piston in both directions along the axis of said cylinder;

(b) a plurality of rod means, each of which is rigidly associated with one of said pistons for movement therewith and each of which includes a slide rod mounted for linear slidable movement a bearing means, said plurality of slide rods all being arranged in close parallel relation to one another; and (c) a plurality of connecting means, each of said connecting means connecting one of said slide rods to one of said guide bars to transmit directly said linear movement of said slide rods to said guide bars for effecting said lapping movement thereof, said connecting means including spherical bearing means interconnecting said rod means and said guide bar to permit said guide bar to make front and back swing movements with respect to said guide bar without affecting said direct transmission of said linear movement of said rod means to said guide bar.

6. A mechanism for effecting guide bar lapping movement in warp knitting, said mechanism comprising:

(a) a fluid drive servo motor means including a cylinder element and a double-acting, piston element arranged therein, one of said cylinder element or said piston elements being movable by fluid introduced into said cylinder, and control means for introducing fluid into said cylinder for causing selective movement of said movable element;

(b) rod means rigidly associated with said movable element for linear movement therewith, said rod means including a piston rod connected directly to said piston element and extending away from both ends of said piston element, a yoke connected to said piston rod, and a slide rod connected to said yoke and mounted for linear movement in bearing means; and (c) connecting means for connecting said rod means to transmit directly said linear movement of said rod means to said guide bar and to permit movements of said guide bar with respect to said rod means in directions of movement transverse to said linear movement of said rod means.

7. A mechanism for effecting the lapping movement of a plurality of guide bars in a warp knitting machine said mechanism comprising:

(a) a plurality of fluid drive motor including a cylinder, a double-acting piston arranged for movement within said cylinder, and a control means for introducing fluid into said cylinder for selectively moving said piston in both directions along the axis of said cylinder;

(b) a plurality of rod means, each of which includes a piston rod connected directly to said piston for movement therewith with said piston rod extending away from both ends of said piston, and each of which includes a yoke connected to said piston rod and a slide rod connected to said yoke and mounted for linear movement in bearing means, said plurality of slide rods all being arranged in close parallel relation to one another; and (c) a plurality of connecting means, each said connecting means connecting one of said slide rods to one of said guide bars to transmit directly said linear movement of said slide rods to said guide bars for effecting said lapping movement thereof and to permit movements of said guide bars with respect to said slide rods in directions of movement transverse to said linear movement of said slide rods.

* * * * *